US005179436A

United States Patent [19]

Asdollahi et al.

[11] Patent Number: 5,179,436

[45] Date of Patent: Jan. 12, 1993

[54] ELECTRIC FUSE

[75] Inventors: Norbert Asdollahi; Jörg Deckert, both of Witten; Christine Degener, Bochum; Claus Friedrich, Gevelsberg; Bernd Fröchte, Herne; Heinrich Pferdekämper, Freilassing; Detlef Plegge, Recklinghausen; Karl Poerschke, Sprockhövel; Klaus Stärk, Witten, all of Fed. Rep. of Germany

[73] Assignee: Wickmann-Werke GmbH, Witten, Fed. Rep. of Germany

[21] Appl. No.: 788,239

[22] Filed: Nov. 5, 1991

[30] Foreign Application Priority Data

May 11, 1990 [DE] Fed. Rep. of Germany ... 9015208[U]

[51] Int. Cl.[5] ..... H01H 85/02; H01H 85/04

[52] U.S. Cl. ..... 337/203; 337/249; 337/281

[58] Field of Search ..... 337/203, 249, 250, 280, 337/281

[56] References Cited

U.S. PATENT DOCUMENTS

| | | | |
|---|---|---|---|
| 426,156 | 4/1890 | Warrell | 337/203 |
| 1,502,881 | 7/1924 | Sandin | 337/250 |
| 2,166,174 | 7/1939 | Popp | 337/249 |
| 2,245,345 | 6/1941 | Klein | 337/203 |
| 3,832,666 | 8/1974 | Griffin | 337/203 |
| 4,417,226 | 11/1983 | Asdollahi et al. | 337/280 |
| 4,808,962 | 2/1989 | Ikeda | 337/203 |

*Primary Examiner*—Harold Broome

*Attorney, Agent, or Firm*—Banner, Birch, McKie & Beckett

[57] ABSTRACT

The invention relates to an electric fuse with a fuse element located in a housing which encases a fuse element chamber. The fuse element melts and thus cuts out the fuse under an overcharge, whereby the temperature and pressure in the interior of the casing will abruptly rise. The housing is provided with a pressure relief means through which at least part of the gas volume can be let off to the outside to prevent the housing from destruction if high internal pressure peak values occur on cutting out the fuse.

13 Claims, 5 Drawing Sheets

ELECTRIC FUSE

BACKGROUND OF THE INVENTION

1. Field of the Invention

The invention relates to an electric fuse having a housing which encases a fuse element located in a chamber. The fuse element melts and thus cuts out the fuse under an overcharge, whereby the temperature and pressure in the interior of the chamber will abruptly rise.

If the pressure developed in the chamber on cutting out a fuse exceeds a given limit, the housing is destroyed in an explosion-like manner. If the housing e.g. comprises a base and a cap, which engages over the base and is fixed thereto to form the chamber, the cap is blown off the base if the internal pressure of the chamber rises beyond a given limit. The switching or breaking capacity of a fuse is decisively dependent on the internal pressure of the chamber which occurs on reaching a corresponding cutout current and which can be sustained by the housing without a destruction risk.

2. Prior Art

Numerous different measures are known for preventing or at least delaying the rapid rise of the chamber internal pressure on cutting out the fuse, so as to increase the switching capacity of the latter. These measures can only be carried out on a limited number of fuse types and also only allow a limited increase in the fuse switching capacity.

OBJECT OF THE INVENTION

The object of the invention is therefore to increase the switching capacity of electric fuses of the aforementioned type in a simple, reliable and inexpensive manner.

SUMMARY OF THE INVENTION

According to the invention this object is met in that the housing is provided with pressure relief means for relieving pressure created within said fuse chamber by the expansion of gases when the fuse element opens.

Therefore the invention adopts a new procedure, in that a destruction of the housing, if high internal pressure peak values occur on cutting out the fuse, is prevented by leading off at least part of the gas volume to the outside from the fuse chamber, namely by means of a pressure relief means. The total tightness of the fuse chamber is abruptly given up by the pressure relief means, so that the gas pressure immediately drastically drops and part of the gas volume is discharged to the outside. This measure is preferable to an uncontrolled destruction of the fuse in the case of very high cutout currents.

In principle, there are two alternatives for the design of the pressure relief means.

In the first alternative, according to the invention at least one opening in the fuse element chamber forms the pressure relief means in such a way that on cutting out the fuse an adequate gas volume proportion can escape to the outside through the opening. The opening is located in the chamber where it is possible to accept an escape of a proportion of the gas volume. From the outset the fuse element chamber has one or more openings, which ensure an adequate internal pressure limitation of the fuse in the case of a high cutout current.

In the second alternative, according to the invention by the pressure rise in the casing occuring on cutting out the fuse, at least one opening in the chamber is freed for forming the pressure relief means in such a way that on cutting out the fuse an adequate gas volume porportion can escape to the outside through the opening. According to this solution, the fuse has a fuse element chamber closed in pressure-tight manner, but in which by means of predetermined rupture location it is ensured that if harmful pressure peak values occur openings form in the casing at the predetermined rupture location and through them there can be an adequate gas volume escape to the outside for the pressure relief of the fuse element chamber.

To prevent the gas flow passing out of the opening from striking adjacent components or the like, according to a further development of the invention the opening is faced by a baffle element, e.g. a baffle plate in such a way that the outflowing gases are deflected and also cooled. When the gases flow out, the deflection keeps the said gases initially in the vicinity of the fuse.

On the inside the opening or the openings are preferably covered by an element, e.g. by a ceramic paper insert or a foil, which acts as a filter, cooling medium and valve or flow resistor when the gas flows out. This in particular also prevents metal vapours, which can form when the fuse element melts, from passing in unimpeded manner into the vicinity of the fuse.

For the version in which openings in the chamber only form when pressure peak values occur, according to the invention the openings in the casing wall are in the form of recesses, whose thin-walled closure can be blown off by the gas pressure on cutting out the fuse.

Another version of the inventive fuse is characterized in that the openings, which form in the manner of pressure relief means in the case of high compressive loads, on cutting out the fuse, are formed by housing expansions more particularly between ribs and locking grooves of housing parts interconnected by such locking elements, the housing parts having different expansion characteristics. The latter is based on the design and e.g. occurs where a fuse, such as a miniature fuse, comprises a base, over which engages a cap and which is fixed to said base. When high pressures occur, the cap wall at this point is subject to a much higher expansion as compared with the relatively solid base.

According to a further development of the invention, the housing encasing the fuse element chamber has a relief chamber on the side of the openings. Here again the openings are covered by a corresponding element on the way from the main chamber to the relief chamber, e.g. by a ceramic paper insert or foil, whose action has been explained hereinbefore. In the case of peak pressure stresses in the fuse element chamber, part of the gas volume can pass via the openings into the relief chamber, which brings about a cooling of said gas volume and therefore a corresponding pressure relief.

The invention is particularly suitable for miniature fuses, in which the gas volume enclosed in the fuse element chamber is particularly small and is therefore suddenly heated by the heat released as a result of the melting of the fuse element and is consequently subject to a corresponding pressure rise. Thus, an advantageous further development or use of the invention is characterized in that, in known manner, the housing comprises a base and a cap, which form a chamber, in which are arranged pins carrying the fuse element and that the opening or the openings which form in the case of an overload are located in the fuse cap. The relatively thin-walled cap is suitable for the production of such openings and the space in the vicinity of the fuse into which the gas volume parts can flow, is generally positioned above the fuse or laterally thereof.

Another development of the invention comprises a rectangular shape of the housing formed by the base and the cap, which engages over the base and which has as fastening elements, e.g. snapping elements. This kind of a miniature fuse is of particular interest, because the smaller end faces in the case of a rapid pressure rise within the chamber are subject to a smaller bulging than the larger lateral faces. In the case of a locking fastening between the cap and base by means of ribs and locking grooves on the smaller end faces, on reaching or exceeding specific internal pressure peak values as a result of the different bulging or curvature of the end and lateral faces an opening gap can form between the lateral faces and the corresponding opposite faces of the base through which a gas volume proportion can escape. As a result of the high pressure load on the long lateral faces of the cap correspondingly high pulling forces act on the end faces of the cap, so that the latter, with the two end faces, at the instant of reaching very high internal pressure values is pressed very firmly onto the corresponding frontal opposite faces of the base and therefore onto the locking ribs located there. The greater rigidity of the end faces of the cap contributes to the varying bulging of the end faces and the lateral faces.

According to an advantageous further development of the above described design only the end faces of the cap and the corresponding frontal opposite faces of the base are interconnected, more particularly by a locking fastening. This facilitates the formation of an opening gap on the long rectangular sides. The cooling of the escaping gas proportion on the gap walls can be enhanced by the insertion of cooling elements.

It is possible for the cross-sectionally round or angular cap to have an opening on its side facing away from the base which can be closed by a cover to be fastened with locking elements as a pressure relief means. Thus, in the case of an overpressure, relief openings form on the top of the fuse housing, namely between the locking elements, by means of which the cover is fixed to the cap.

BRIEF DESCRIPTION OF THE DRAWINGS

Other and further objects of the present invention will be apparent from the following description and claims and are illustrated in the accompanying drawings, which by way of illustration schematically show prefered embodiments of the present invention and the principles thereof and what now are considered to be the best modes contemplated for applying these principles. Other embodiments of the invention embodying the same or equivalent principles may be used and structural changes may be made as desired by those skilled in the art without departing from the present invention and the scope of the appended claims.

Embodiments of the invention are described in greater detail hereinafter relative to the accompanying drawings, wherein show.

DETAILED DESCRIPTION OF THE EMBODIMENTS

Figure 1:
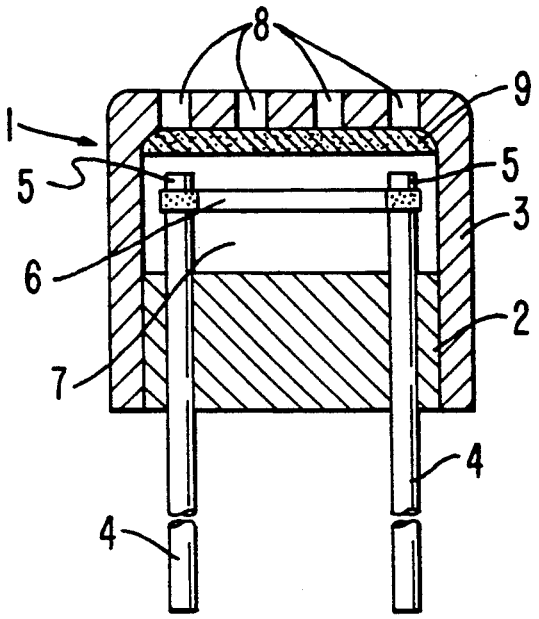
FIG. 1 a cross-sectional view of a miniature fuse with openings forming a pressure relief means in a cap of said fuse.

In the embodiment of FIG. 1, a miniature fuse housing 1 comprises two plastic parts, namely a base 2 and a cap 3, which together with the base 2 forms a chamber 7 and to which is fixed the base 2 in the represented position, e.g. by a bond and/or a locking connection. In known manner the base 2 is traversed by two, spaced, metallic connecting pins 4 and on the upper ends 5 of said pins 4 a fuse element 6 is fixed in the chamber 7 in an appropriate manner, e.g. by soldering or welding.

As shown, on the top of the cap 3 there are several openings 8, which are closed on the inside by a ceramic paper insert 9 or by a thin foil. As explained hereinbefore, the openings 8 serve to relieve the casing when pressure peak values occur and which are obtained on cutting out the fuse, namely when the fuse element 6 melts. In this case part of the gas volume can escape to the outside from the chamber 7 through the insert 9 and the openings 8. The insert 9 acts as a cooling medium and filter or valve, which is positioned upstream of the openings 8 and has an energy absorbing function in conjunction with a filtering and cooling function.

Figure 2:
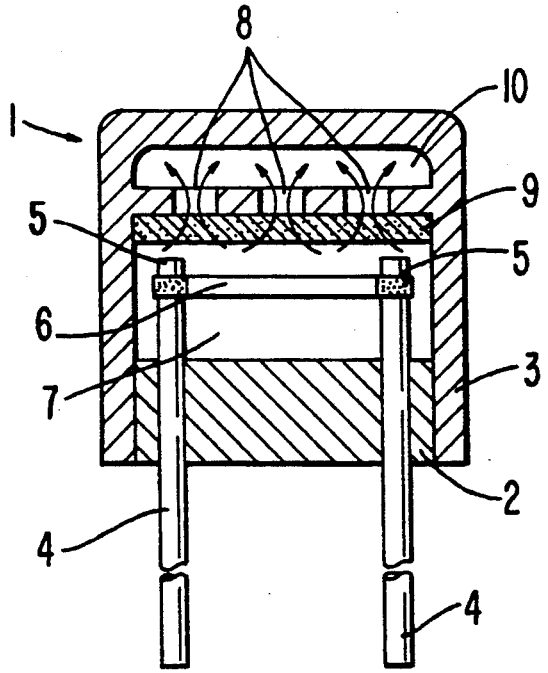
FIG. 2 a cross-sectional view of a miniature fuse, whose fuse element chamber is connected by means of openings to a relief chamber.

In the second embodiment according to FIG. 2, whose fundamental construction of a miniature fuse has the same reference numerals for the same parts as in FIG. 1, unlike in the embodiment of FIG. 1, the top of the cap 3 is provided with a relief chamber 10. For relieving the chamber 7 when internal pressure peak values occur, part of the gas volume can pass from the chamber 7, through the insert 9 and the openings 8 into the relief chamber 10. As a function of the pressure peak value reached, the relief effect here is less than in the case of the embodiment of FIG. 1, because the volume and therefore the absorption capacity of the relief chamber 10 can only be relatively small. The cooling action and energy absorption are of the same order of magnitude. The main advantage of this embodiment is that the gas-tightly sealed nature of the casing 1 with respect to the environment is also maintained in the case of peak loads, so that no gases flow out.

Figure 3:
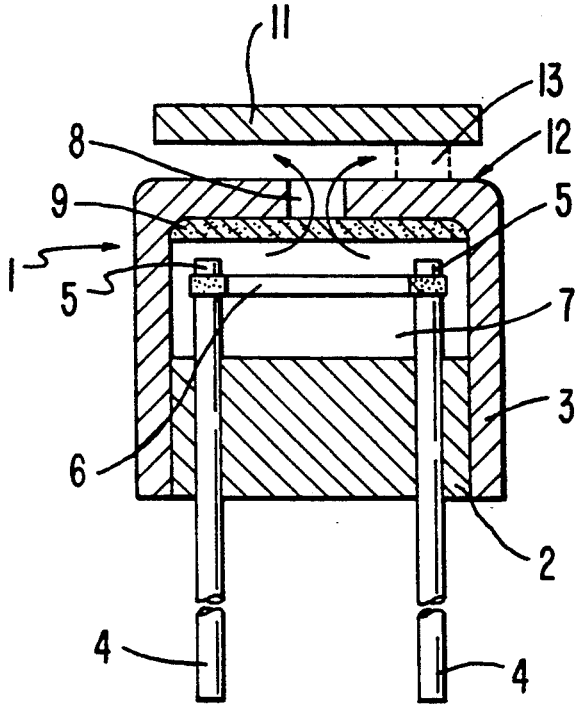
FIG. 3 a cross-sectional view of a miniature fuse with an opening in the fuse cap and with a baffle plate.

Also in the case of the miniature fuse shown in FIG. 3 the basic construction is the same as for the embodiments of FIGS. 1 and 2. The essential difference is that on the top of the miniature fuse cap 3 is provided a central opening 8, which is faced in spaced manner by a baffle element 11. Thus, outflowing gases, as indicated by the arrows in the drawing, are deflected between the surface 12 of the cap 3 and the baffle element 11, constituted by a baffle plate here, and are led away laterally, which leads to a cooling action. The baffle element 11 can be fixed in any manner spaced above the surface 12 the cap 3, e.g. by support elements 13 constructed in one piece with the baffle element 11 and which are bonded to the surface 12 of the cap 3 and which form an adequate passage for the outflowing gases. The support element can also be constituted e.g. by a ring with corresponding laterally directed recesses or openings.

Figure 4:
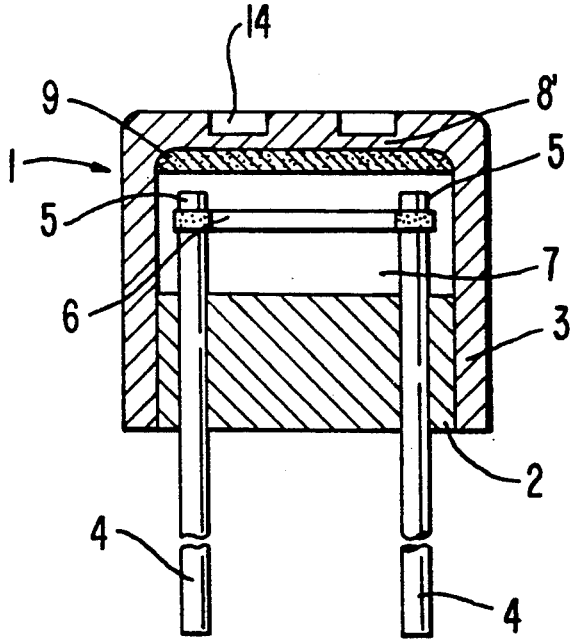
FIG. 4 a cross-sectional view of a miniature fuse with a pressure relief means in the form of openings, which form on pre-established thin-walled recesses of the fuse cap in the case of an overload.

The miniature fuse embodiment shown in FIG. 4 has, unlike the three previously described embodiments, no openings in the housing 1 and in this case, as shown in FIG. 4, openings 8' as relief openings only form when internal pressure peak values are reached, which threaten to blow up the housing 1. For this purpose are provided at certain points, namely on the top of the cap 3 in the casing wall thereof a number of recesses 14, which form corresponding thin-walled predetermined breaking points and on exceeding predetermined internal pressure values can be fractured for forming openings 8'. Here again, it is additionally possible to use an insert, as shown in the embodiments 1 and 2. The same possibility exists in the embodiment according to FIG. 3.

Figure 5:
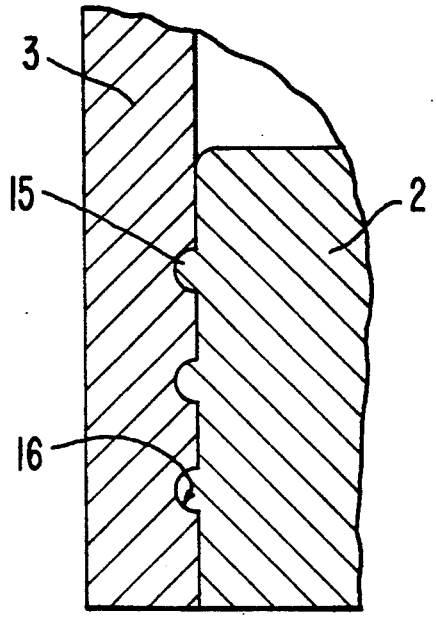
FIGS. 5 and 6 cross-sectional representations of a locking connection formed by ribs and locking grooves without and with pressure relief.
Figure 6:
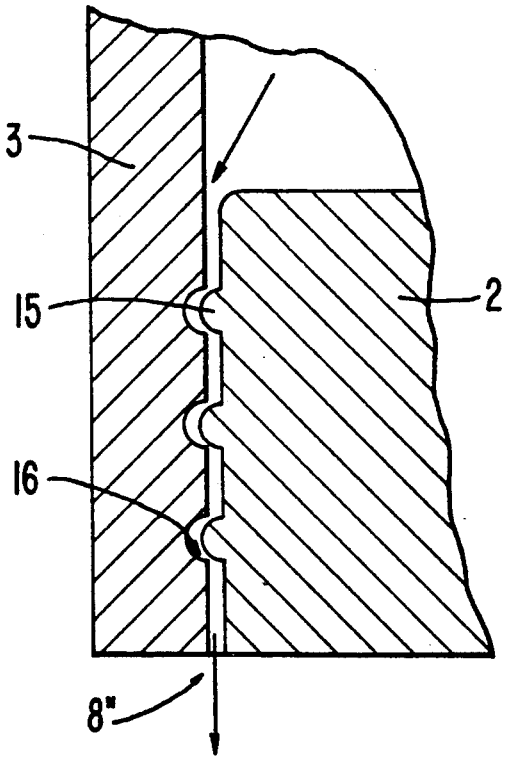

FIGS. 5 and 6 illustrate the use of certain locking fastenings between the casing parts, such as the base 2 and the cap 3. The cross-sectional shape of the ribs 15 and locking grooves 16 used is selected so that a through opening 8'' is formed, if the cap wall is expanded when internal pressure peak values occur, so that the locking grooves 16 are raised from the ribs 15. The design and dimensioning of the locking connection are to be such that there is an effective pressure relief of the fuse element chamber, without completely eliminating the engagement of the ribs 15 in the locking grooves 16. The arrows in FIG. 6 indicate the flow path of a gas volume proportion on its way to the outside.

Figure 7:
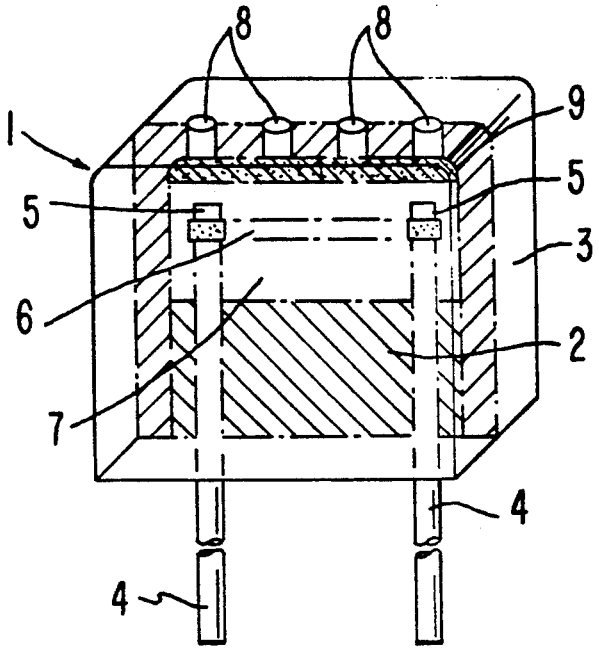
FIG. 7 a diagrammatic perspective view of a miniature fuse with a rectangular cross-section.

The miniature fuses in the embodiments according to FIGS. 1,2,3 and 4, whereof in each case only a sectional view is shown, can either have a preferably circular cross-section, so that overall the fuses are cylindrical, or can be box-shaped, as shown in FIG. 7. The first part of the description indicated the pressure relief actions in the case of fuses with a rectangular cross-section.

Figure 8:
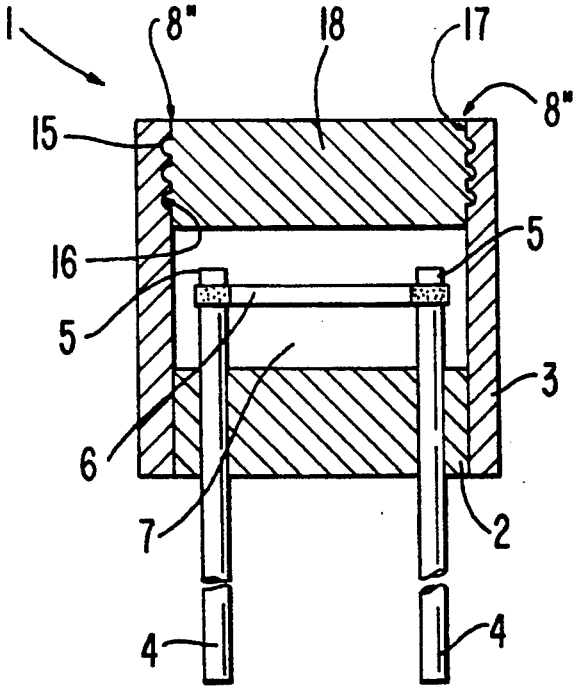
FIG. 8 a cross-sectional view of a miniature fuse with a cap closable by a cover.

FIG. 8 shows a miniature fuse, whose cap 3 has an upper opening 17, which can be closed by means of a plastic cover 18 with a locking connection formed by ribs 15 and locking grooves 16. This makes it possible to obtain the relief action shown in FIGS. 5 and 6 when internal pressure peak values occur.

Figure 9:
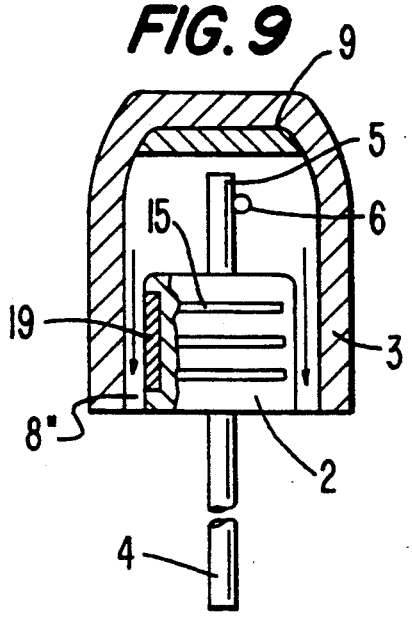
FIG. 9 a cross-sectional view of a miniature fuse with a rectangular cross-section with a cap expanded under the influence of a very high internal pressure.
Figure 10:
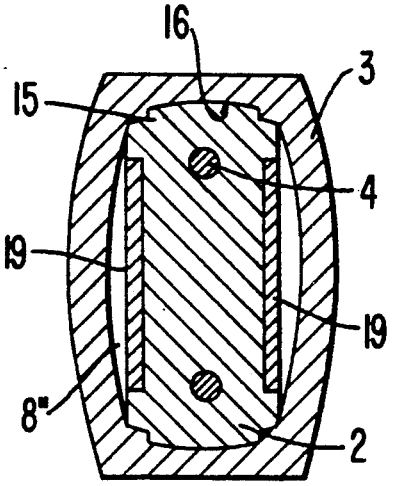
FIG. 10 a cross-sectional view relative to FIG. 9 with the sectional plane displaced by 90°.

In the embodiment according to FIGS. 9 and 10 the same references indicate the same parts or parts of the same nature as in the preceding embodiments. However, it is important here that a locking fastening between the base 2 and the cap 3 is only provided on the small ends, so that if the internal pressure abruptly rises, a particularly marked opening gap 8'' is obtained, as shown in the drawing. The latter illustrates the bulging or expansion of the cap 3 on reaching a high internal pressure value. In the normal or inoperative position the long sides of the base 2 and the cap 3 engage on one another. As is also shown in FIGS. 9 and 10, at least along part of the opening gap 8'', cooling elements 19 can in particular be inserted in the base 2. The cooling elements 19 are made from materials with particulary good thermal conductivity and high specific thermal capacity. They are intended to reinforce the cooling obtained on the wall of the gap 8'' when part of the gas flows out.

What is claimed is:

1. An electrical fuse having a current carrying fuse element which opens to interrupt the flow of current at a predetermined magnitude of current flow, said fuse comprising:

a housing which encases said fuse element in a fuse element chamber, said housing being formed by a wall with a first portion having a first predetermined thickness and a second portion having a second predetermined thickness, said second predetermined thickness being less than said first predetermined thickness to form a predetermined rupture location; and pressure relief means for relieving pressure created within said fuse chamber by the expansion of gases when said fuse element opens, said pressure relief means being formed in said housing at the predetermined rupture location by a rupture of said housing at the predetermined rupture location, said rupture forming a passageway which connects an interior of said fuse element chamber to an exterior of said housing, said passageway being adapted to permit gases heated within said fuse element chamber when said fuse element opens to escape from said fuse element chamber to the exterior of said housing.

2. A fuse in accordance with claim 1, where said housing and said fuse element chamber are circular in construction.

3. A fuse in accordance with claim 1, where said housing and said fuse element chamber are rectangular in construction.

4. A fuse in accordance with claim 1, wherein said passageway being adapted to restrict and cool the flow of gases escaping through said passageway.

5. An electrical fuse having a current carrying fuse element which opens to interrupt the flow of current at a predetermined magnitude of current flow, said fuse comprising:

a housing which encases said fuse element in a fuse element chamber, said housing being formed by a wall with a first portion having a first predetermined thickness and a second portion having a second predetermined thickness, said second predetermined thickness being less than said first predetermined thickness to form a predetermined rupture location;

pressure relief means for relieving pressure created within said fuse chamber by the expansion of gases when said fuse element opens, said pressure relief means being formed in said housing at the predetermined rupture location by a rupture of said housing at the predetermined rupture location, said rupture forming a passageway which connects an interior of said fuse element chamber to an exterior of said housing, said passageway being adapted to permit gases heated within said fuse element chamber when said fuse element opens to escape from said fuse element chamber to the exterior of said housing; and filter means located within said housing adjacent said passage way for filtering said gases prior to escaping through said passageway.

6. A fuse in accordance with claim 5, wherein said filter means is adapted to restrict and cool the flow of gases escaping through said passageway.

7. A fuse in accordance with claim 5, wherein said filter means is formed of ceramic paper.

8. An electrical fuse having a current carrying fuse element which opens to interrupt the flow of current at a predetermined magnitude of current flow, said fuse comprising:

a housing which encases said fuse element in a fuse element chamber, the housing being formed by a first wall section having a first expansion rate under a certain gas pressure and a second wall section having a second expansion rate under said certain gas pressure, said first expansion rate being less than said second expansion rate, said first wall section and said second wall section being snap-fastened to each other by at least one locking rib in one of said first or second wall second and at least one groove formed in said other of said first of second wall section; and pressure relief means, formed in said housing, for relieving pressure created within said fuse chamber by the expansion of gases when said fuse element opens, said pressure relief means being a passageway between both said wall sections when said certain pressure bulges said second wall section more than said first wall section due to the different expansion rates.

9. A fuse in accordance with claim 8, wherein said first wall section is a base of said housing and said second wall section is a cap of said housing, said base and said cap forming said fuse element chamber.

10. A fuse according to claim 8, wherein said first wall section is a cover and said second wall section is a cap, said cover closing an opening within said cap, said cap and said cover forming part of the fuse element chamber.

11. A fuse in accordance with claim 8, further comprising filter means, located within said housing adjacent said passageway, for filtering said gases prior to escaping through said passageway.

12. A fuse in accordance with claim 11, wherein said filter means is adapted to restrict and cool the flow of gases escaping through said passageway.

13. A fuse in accordance with claim 11, wherein said filter means is formed of ceramic paper.

* * * * *